US009273270B2

(12) United States Patent
Adamy et al.

(10) Patent No.: US 9,273,270 B2
(45) Date of Patent: Mar. 1, 2016

(54) UNIT DOSE CLEANING PRODUCTS FOR DELIVERING A PEROXIDE-CONTAINING BLEACHING AGENT

(71) Applicant: CHURCH & DWIGHT CO., INC., Princeton, NJ (US)

(72) Inventors: Steven T. Adamy, Lawrenceville, NJ (US); Lauren Ciemnolonski, Princeton, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 31 days.

(21) Appl. No.: 14/184,789

(22) Filed: Feb. 20, 2014

(65) Prior Publication Data

US 2015/0232787 A1 Aug. 20, 2015

(51) Int. Cl.

| | |
|---|---|
| ***C11D 3/39*** | (2006.01) |
| ***C11D 3/395*** | (2006.01) |
| ***C11D 17/00*** | (2006.01) |
| ***C11D 3/386*** | (2006.01) |
| ***C11D 3/12*** | (2006.01) |
| ***C11D 17/04*** | (2006.01) |
| ***C11D 1/00*** | (2006.01) |

(52) U.S. Cl.

CPC *C11D 3/395* (2013.01); *C11D 1/00* (2013.01); *C11D 3/124* (2013.01); *C11D 3/386* (2013.01); *C11D 3/3902* (2013.01); *C11D 3/3905* (2013.01); *C11D 3/3917* (2013.01); *C11D 3/3942* (2013.01); *C11D 17/043* (2013.01); *C11D 17/044* (2013.01)

(58) Field of Classification Search

CPC ..... C11D 1/00; C11D 3/386; C11D 3/3902; C11D 3/3905; C11D 3/3917; C11D 3/3942; C11D 17/043; C11D 17/044; C11D 3/124

See application file for complete search history.

(56) References Cited

U.S. PATENT DOCUMENTS

| | | | | |
|---|---|---|---|---|
| 3,308,067 | A | 3/1967 | Diehl | |
| 3,936,448 | A | 2/1976 | Lamberti | |
| 3,954,858 | A | 5/1976 | Lamberti et al. | |
| 4,526,698 | A | 7/1985 | Kuroda et al. | |
| 4,652,391 | A | 3/1987 | Balk | |
| 5,476,608 | A | 12/1995 | Boyer et al. | |
| 5,714,449 | A | 2/1998 | Donker et al. | |
| 6,187,739 | B1 | 2/2001 | Merz et al. | |
| 6,281,187 | B1 * | 8/2001 | Smerznak | 510/418 |
| 6,372,703 | B1 | 4/2002 | Richter et al. | |
| 6,475,977 | B1 * | 11/2002 | Pfeiffer et al. | 510/439 |
| 6,479,448 | B2 | 11/2002 | Cropper et al. | |
| 6,486,116 | B1 | 11/2002 | Hinton | |
| 6,521,581 | B1 | 2/2003 | Hsu et al. | |
| 6,656,899 | B1 | 12/2003 | Sadlowski et al. | |
| 6,683,038 | B2 | 1/2004 | Forth et al. | |
| 6,686,325 | B2 | 2/2004 | Hoyt et al. | |
| 7,074,748 | B2 | 7/2006 | Becks et al. | |
| 7,435,714 | B2 | 10/2008 | Kottke et al. | |
| 7,615,524 | B2 | 11/2009 | Del Duca et al. | |
| 7,910,535 | B2 | 3/2011 | Panandiker et al. | |
| 8,314,057 | B2 | 11/2012 | Christansen et al. | |
| 8,524,646 | B2 * | 9/2013 | Ricci et al. | 510/296 |
| 2002/0187916 | A1 * | 12/2002 | Pfeiffer et al. | 510/439 |
| 2003/0134766 | A1 | 7/2003 | Jones et al. | |
| 2003/0139318 | A1 * | 7/2003 | Pfeiffer et al. | 510/439 |
| 2003/0148908 | A1 * | 8/2003 | Michel et al. | 510/296 |
| 2003/0199414 | A1 * | 10/2003 | Boutique et al. | 510/293 |
| 2004/0063601 | A1 * | 4/2004 | Denome et al. | 510/407 |
| 2004/0121926 | A1 * | 6/2004 | Waits et al. | 510/221 |
| 2004/0147423 | A1 * | 7/2004 | Scialla et al. | 510/372 |
| 2004/0186034 | A1 | 9/2004 | Verrall et al. | |
| 2006/0063691 | A1 * | 3/2006 | Carlomagno et al. | 510/295 |
| 2006/0281658 | A1 | 12/2006 | Kellar et al. | |
| 2007/0093402 | A1 * | 4/2007 | Assmann et al. | 510/302 |
| 2008/0146481 | A1 | 6/2008 | Brown et al. | |
| 2010/0120650 | A1 * | 5/2010 | Pfeiffer et al. | 510/221 |
| 2010/0327225 | A1 * | 12/2010 | Bianchetti et al. | 252/188.21 |
| 2011/0188784 | A1 * | 8/2011 | Denome et al. | 383/1 |
| 2011/0303576 | A1 * | 12/2011 | Ricci et al. | 206/524.1 |
| 2012/0053105 | A1 | 3/2012 | Olson et al. | |
| 2012/0245228 | A1 | 9/2012 | Harvey et al. | |
| 2012/0260433 | A1 * | 10/2012 | Tetard et al. | 8/137 |
| 2012/0297551 | A1 * | 11/2012 | Grande et al. | 8/137 |

FOREIGN PATENT DOCUMENTS

| | | | |
|---|---|---|---|
| DE | 2321001 | A1 | 11/1973 |
| GB | 1261829 | A | 1/1972 |
| GB | 1379241 | A | 1/1975 |
| GB | 1387447 | A | 3/1975 |
| GB | 1389732 | A | 4/1975 |
| GB | 1398421 | A | 6/1975 |
| GB | 1398422 | A | 6/1975 |
| GB | 1425343 | A | 2/1976 |
| GB | 1439000 | A | 6/1976 |
| NL | 7205873 | A | 11/1972 |
| WO | 87/01746 | A1 | 3/1987 |
| WO | 9318124 | A1 | 9/1993 |
| WO | 2006130647 | A1 | 12/2006 |
| WO | 2007111888 | A1 | 10/2007 |
| WO | 2011018756 | A2 | 8/2010 |

* cited by examiner

*Primary Examiner* — Gregory R Delcotto

(74) *Attorney, Agent, or Firm* — Fishman & Associates, LLC

(57) ABSTRACT

A unit dose cleaning product for delivering a peroxide-containing bleaching agent, includes a peroxide-containing bleaching agent component containing a peroxide-containing bleaching agent and a first at least partially water soluble material encapsulating the peroxide-containing bleaching agent, a peroxide bleach activating agent component including a peroxide bleach activating agent, and having the peroxide-containing bleaching agent component dispersed therein forming a cleaning composition, and a pouch made of a second at least partially water soluble material enclosing the cleaning composition, wherein the first at least partially water soluble material of the peroxide-containing bleaching agent component exhibits a substantially longer dissolution time than the second at least partially water soluble material of the pouch.

32 Claims, 4 Drawing Sheets

UNIT DOSE CLEANING PRODUCTS FOR DELIVERING A PEROXIDE-CONTAINING BLEACHING AGENT

FIELD OF THE INVENTION

The present invention relates to cleaning products, and more particularly to unit dose cleaning products for delivering a peroxide-containing bleaching agent.

BACKGROUND OF THE INVENTION

Peroxide-based bleaching agents (e.g., hydrogen peroxide, sodium percarbonate, sodium persulfate, sodium perphosphate, urea peroxide, and sodium perborate) act as effective oxidizers for whitening substrates, removing stains, and disinfecting surfaces. Peroxide-based bleaching agents promote a bleaching effect on organic materials and thus are used with detergents in cleaning compositions, and are also used for bleaching textiles and paper, among other applications. The bleaching effect is particularly strong in washing and cleaning processes.

Generally, to clean a soiled substrate such as clothing, the substrate is treated with hydrogen peroxide or a substance capable of generating perhydroxyl ions (HOO—), such as inorganic or organic peroxides as exemplified above. Upon contact with the surface of the soiled substrate, the peroxide effectively removes common stains such as coffee or wine, while disinfecting the surface. Compared to more volatile hypochlorite-based bleaches, peroxide-based bleaching agents exhibit environmental benefits including enhanced safety and reduced pollution. However, peroxide-based bleaching agents do not perform at the same level of cleaning efficacy as hypochlorite-based bleaches.

Peroxide bleach activating agents, or bleach activators, such as, for example, acyl compounds (e.g., tetraacetylethylenediamene (TAED)) and ester compounds (e.g., isononanoyloxybenzenesulfonate (ISONOBS) and nonanoyloxybenzene-sulfonate (NOBS)), and the like, can be added to boost activity of peroxide-based bleaching agents. It has been found that the level of peroxide bleaching activity typically generated at 95° C. by peroxide alone can be achieved at 60° C. with the addition of bleach activators. The bleach activator reacts in the presence of the peroxide-based bleaching agent to generate peracetic acid, which is a more potent oxidizer than hydrogen peroxide.

Liquid formulations containing such bleach activators have met limited consumer success due to a lack of sufficient stability. When the liquid compositions are formulated with dissolved peroxide compounds, the resulting composition is especially unstable, and thus, prone to rapid loss of bleaching efficacy. To prolong stability, the cleaning composition containing peroxide and bleach activator is typically packaged with the actives physically segregated or in an anhydrous environment. This can be achieved by dispersing the actives either in a suspension segregating the peroxide and bleach activator in different liquid phases or blending them in a dry powder form.

Powder and dual-phase liquid formulations are generally less desirable especially for consumer use as compared to other forms of cleaning compositions. Even when maintained in an anhydrous environment (i.e., powder and dual-phase liquid), the bleach activator can still react with the peroxide. Over time, the bleach activator and peroxide degrade leading to reduced efficacy.

Accordingly, there is a need for a unit dose cleaning product for delivering a peroxide-containing bleaching agent that is formulated to alleviate the limitations described above and which prevents premature degradation of the peroxide-containing bleaching agent. There is a further need for a unit dose cleaning product for delivering a peroxide-containing bleaching agent comprising a cleaning composition of the peroxide-based bleaching agent and a peroxide bleach activating agent, having improved stability over time, while enhancing convenience and ease of use for the consumer. There is also a need for a unit dose cleaning product for delivering a peroxide-containing bleaching agent that promotes cleaning of substrates in a more environmentally-friendly manner.

SUMMARY OF THE INVENTION

The present invention relates to a unit dose cleaning product for delivering a peroxide-containing bleaching agent. The unit dose cleaning product of the present invention is specifically formulated for enhanced cleaning (bleaching) activity, while substantially improving peroxide stability and therefore providing an extended shelf-life. The unit dose cleaning product of the present invention utilizes a combination of a peroxide-containing bleaching agent and a peroxide bleach activating agent for enhanced bleaching activity, formulated for improved stability over time with minimal loss of efficacy during storage. The configuration of the unit dose cleaning product also provides a vehicle to delay immediate release of the peroxide-containing bleaching agent until the product is completely dispersed in an aqueous environment. This delay substantially minimizes premature interaction between the peroxide-containing bleaching agent and the peroxide bleach activating agent, thereby maximizing cleaning efficacy.

The unit dose cleaning product of the present invention is especially formulated for cleaning soiled substrates, such as, for example, laundry and dishware. The unit dose cleaning product is designed to provide a self-contained single-dose package that permits the consumer to dispense the product without the need to measure the amount of the active agent. In this manner, the unit dose cleaning product of the present invention enhances ease of use and dispensing for reduced waste, and at least minimizes skin contact with potentially irritating ingredients.

In particular, the unit dose cleaning product of the present invention includes a cleaning composition of a peroxide-containing bleaching agent component comprising a peroxide-containing bleaching agent, preferably in the form of anhydrous particles encapsulated in a first at least partially water soluble material. The cleaning composition also contains a peroxide bleach activating agent component containing a peroxide bleach activating agent, preferably in the form of a non-aqueous liquid. A pouch comprising a second at least partially water soluble material enclosing the cleaning composition is also provided. The first at least partially water soluble material of the peroxide-containing bleaching agent component has a substantially longer dissolution time than the second at least partially water soluble material of the pouch. Optionally, the cleaning composition of the present unit dose cleaning product further includes one or more surfactants, detergents and enzymes, each in amounts effective for promoting cleaning of soiled substrates.

As used herein, the term "encapsulate" is used in its customary and ordinary sense where the first at least partially water soluble material provides a barrier which protects the material contained therein (the peroxide-containing bleaching agent) until the first at least partially water soluble material begins to dissolve.

The term "enclosing" refers to the second at least partially water soluble material forming a pouch which protects the contents of the cleaning composition (including the encapsulated peroxide-containing bleaching agent) until the second at least partially water soluble material begins to dissolve.

In one aspect of the present invention, there is provided a unit dose cleaning product for delivering a peroxide-containing bleaching agent, comprising:

a peroxide-containing bleaching agent component comprising a peroxide-containing bleaching agent and a first at least partially water soluble material encapsulating the peroxide-containing bleaching agent;

a peroxide bleach activating agent component comprising a peroxide bleach activating agent, and having the peroxide-containing bleaching agent component dispersed therein forming a cleaning composition; and a pouch comprising a second at least partially water soluble material enclosing the cleaning composition, wherein the first at least partially water soluble material of the peroxide-containing bleaching agent component exhibits a substantially longer dissolution time than the second at least partially water soluble material of the pouch. Optionally, the peroxide bleach activating agent is in the form of a non-aqueous liquid.

In another aspect of the present invention, there is provided a method of cleaning soiled substrates, comprising:

dissolving the unit dose cleaning product described above in water to form a cleaning solution; and contacting the cleaning solution with the soiled substrates to remove soils therefrom.

BRIEF DESCRIPTION OF THE DRAWINGS

The following drawings are illustrative of preferred embodiments of the present invention, and are not intended to limit the invention as encompassed by the claims forming part of the application, wherein like items are identified by the same reference designations:

DETAILED DESCRIPTION OF THE INVENTION

Figure 1:
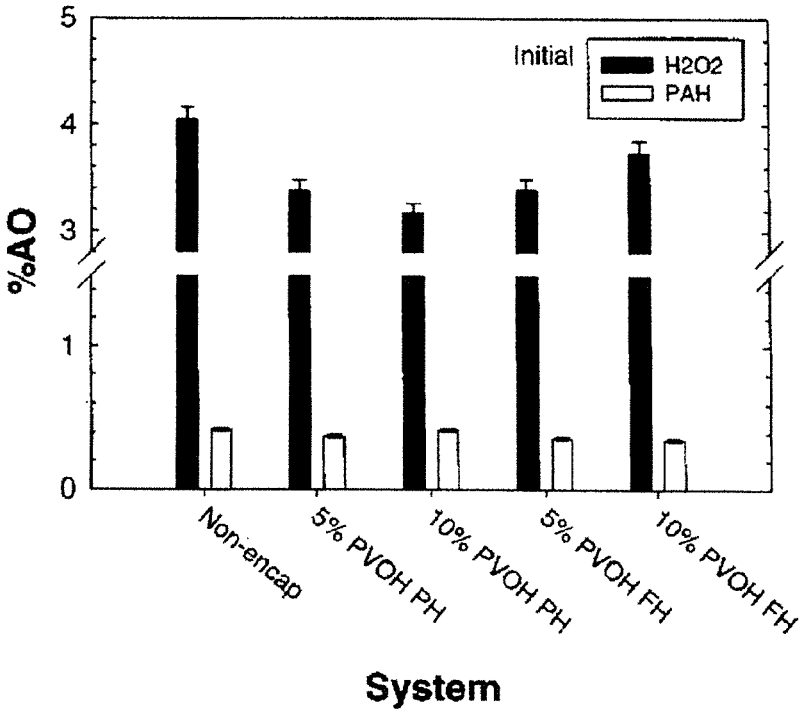
FIG. 1 is a graph plotting data corresponding to the levels of active oxygen (AO) based on the presence of peroxide and peracid, respectively, prior to aging, in accordance with the present invention.

The present invention is directed to a unit dose cleaning product for delivering a peroxide-containing bleaching agent to a substrate. The unit dose cleaning product of the present invention is specifically formulated for enhanced cleaning (bleaching) activity, while substantially improving peroxide stability for extended shelf-life. The unit dose cleaning product of the present invention utilizes a combination of a peroxide-containing bleaching agent and a peroxide bleach activating agent for enhanced bleaching activity, formulated for improved stability over time with minimal loss of efficacy during storage. The configuration of the unit dose cleaning product also provides a vehicle to delay immediate release of the peroxide-containing bleaching agent until the product is completely dispersed in an aqueous environment. This delay substantially minimizes premature interaction between the peroxide-containing bleaching agent and the peroxide bleach activating agent, thereby maximizing cleaning efficacy.

The unit dose cleaning product of the present invention is especially formulated for cleaning soiled substrates, such as, for example, laundry and dishware. The unit dose cleaning product is designed to provide a self-contained single-dose package that permits the consumer to dispense the product without the need to measure the amount of the active agents. In this manner, the unit dose cleaning product of the present invention enhances ease of use and convenient dispensing for reduced waste, and at least minimizes skin contact with potentially irritating ingredients.

As used herein, the term "peroxide-containing bleaching agent" is intended to encompass an agent that contains and/or liberates the peroxide ion.

As used herein, the terms "peroxide bleach activating agent" or "bleach activator" are intended to encompass an agent that reacts with a peroxide-containing bleaching agent to release a more potent oxidizer.

In one embodiment of the invention, the unit dose cleaning product of the present invention includes a cleaning composition of a peroxide-containing bleaching agent component comprising a peroxide-containing bleaching agent, preferably in the form of anhydrous particles encapsulated in a first at least partially water soluble material. The cleaning composition also contains a peroxide bleach activating agent component containing a peroxide bleach activating agent, preferably in the form of a non-aqueous liquid. A pouch comprising a second at least partially water soluble material enclosing the cleaning composition is also provided. The first at least partially water soluble material of the peroxide-containing bleaching agent component has a substantially longer dissolution time than the second at least partially water soluble material of the pouch. Optionally, the cleaning composition of the present unit dose cleaning product further includes one or more surfactants, detergents and enzymes, each in amounts effective for promoting cleaning of soiled substrates.

The term "unit dose cleaning product" as used herein is intended to encompass any product that allows the consumer to add a cleaning composition in the form of a self-contained single dose packaging to a soiled substrate to be washed or cleaned such as, for example, dishware or laundry, without the need for measuring or dispensing the composition by pouring or scooping. The structure of the present unit dose cleaning products generally comprises a container (e.g., pouch) of which may be fashioned in any desirable shape or size and may be prepared in any suitable process such as blowing, extruding or casting, and is filled with a cleaning composition such as through an automated fill process.

The unit dose cleaning product can be suitably adapted for specific use in a particular cleaning appliance such as a laundry washing machine, an automatic dishwashing machine, a floor cleaner machine or the like. For example, one or more of the unit dose cleaning products of the present invention can be introduced into a cleaning appliance configured for cleaning a soiled substrate, whereby the cleaning composition contained therein is released such that it comes into contact with the soiled substrate (e.g., laundry or dishware) under conditions necessary for removing soils therefrom.

The present peroxide-containing bleaching agent component includes the peroxide-containing bleaching agent (preferably in the form of particles) coated or encapsulated with the first at least partially water soluble material. In the preferred embodiment, the shape of the peroxide-containing bleaching agent component is substantially spherical with a particle size diameter of from about 10 to 2000 microns and more preferably from 100 to 1000 microns. It is advantageous if the peroxide-containing bleaching agent exhibits a very low degree of solubility in the non-aqueous liquid which comprises the liquid phase of the composition.

The peroxide-containing bleaching agent is selected from any agent that contains and/or liberates the peroxide ion. The peroxide-containing bleaching agent is selected, for example, from sodium perborate, sodium percarbonate, sodium perphosphate, sodium persulfate, urea peroxide, polyvinylpyrrolidone peroxide and combinations thereof. Preferably, the peroxide-containing bleaching agent is present in amounts of up to 99 wt % based on the total weight of the peroxide-containing bleaching agent component, more preferably, from about 40 wt % to 99 wt % and most preferably from about 85 wt % to 95 wt %.

The coating or encapsulation comprising the first at least partially water soluble material prolongs the time in which the peroxide-containing bleaching agent may remain active by preventing interactions between the peroxide-containing bleaching agent and the peroxide-containing bleach activating agent components that would occur even in an anhydrous environment. The term "at least partially water soluble material" as used herein is intended to refer to material which at least to some extent rupture, dissolve, disintegrate or disperse upon contact with water, resulting in the release of the peroxide-containing bleaching agent. Preferably, the first at least partially water soluble material is water soluble. Partially water soluble to fully water soluble materials may be used.

Preferably, the first at least partially water soluble material of the present invention is selected from any suitable film-forming materials such as polymers, cellulosics, polyacrylics, polyamides, and the like, that are stable and inert relative to the peroxide-containing bleaching agent, and can range from partially soluble to fully soluble in an aqueous solution. Preferred film-forming materials include, but are not limited to, polyvinyl alcohol, polyvinyl pyrrolidone, cellulose ethers, carboxymethylcellulose, and the like. A more preferred film forming material is polyvinyl alcohol.

The film-forming materials of the present invention preferred for use herein possess an average molecular weight of from about 1,000 to 300,000, preferably from about 2,000 to 150,000, more preferably from about 5,000 to 100,000, and most preferably from about 31,000 to 50,000.

In a preferred embodiment of the present invention, the coating of the first at least partially water soluble material may be composed of from about 0.1 wt % to 60.0 wt % based on the total weight of the peroxide-containing bleaching agent component, more preferably from about 1 wt % to 30 wt %, and most preferably from about 5 wt % to 15 wt %. The weight ratio of peroxide-containing bleaching agent to the first at least partially water soluble material is preferably in the range 999:1 to 2:3, more preferably from 99:1 to 7:3.

In a further preferred embodiment of the present invention, the peroxide-containing bleaching agent component comprises particles having a mean particle diameter of from about 0.1 μm to 10.0 mm, preferably from about 10 μm to about 5000 μm, and more preferably from about 100 μm to 2000 μm.

When preparing discrete particles of the peroxide-containing bleaching agent component, such an encapsulated particle is made via any suitable technique recognized in the art which can include, for example, spraying a solution containing the first at least partially water soluble material onto the cores of peroxide-containing bleaching agent in a fluidized bed to form a coating therearound. There are many commercially available fluid bed apparatuses which are suitable for use in the process of the invention, among those is the Model No. GF 3 manufactured and marketed by Glatt Air Techniques of Ramsey, N.J.

In particular, a peroxide-containing bleaching agent can be coated, for example, by preparing a solution of the coating material in a suitable solvent. In the case of polyvinyl alcohol (PVOH), a 10-20% (w/w) solution can be prepared at 80° C.-90° C. Water is first heated to temperature, and the PVOH is slowly added. It is preferred to use an overhead stirrer, stirring at a rate fast enough to produce a vortex extending to about half the depth of the solution. The rate of stirring can be reduced once the PVOH particles are fully dispersed. Stirring continues until a small aliquot can be drawn on a piece of glass with no particles visible in the film. The solution is then pumped into a coater such as the Glatt® ProCell Labsystem equipped with a GF3 insert at a rate of about 9 g/minute, using a peristaltic pump. Coating is continued until the proper coating weight is achieved.

It will be understood that the peroxide-containing bleaching agent may also be coated or encapsulated using other apparatuses such as, for example, a rolling drum, a pan granulator, or a falling curtain spray.

The peroxide-containing bleaching agent component dispersed in the peroxide bleach activating agent component yields the cleaning composition of the present invention. Optionally, the peroxide bleach activating agent is in the form of a non-aqueous liquid. The cleaning composition of the present invention can comprise a variety of additional active ingredients suitable for use in cleaning substrates, including, surfactants, builders, chelators, enzymes, fluorescent whitening agents, anti-redeposition polymers, water conditioners, pH modifiers, and dye-transfer inhibitors.

The present cleaning compositions include those suitable for fabric care or hard surface cleaning. More preferably, the cleaning composition is a laundry, fabric care or dishware washing composition including pre-treatment or soaking compositions and other rinse additive compositions. The cleaning composition can be in any suitable form such as a liquid, a paste, a semi-solid, or a gel. The cleaning composition is at least substantially anhydrous, with a free moisture content at a minimum of 5 wt % or less, based on the total weight of the cleaning composition, and preferably 1 wt % or less.

The peroxide bleach activating agent includes any suitable compounds capable of activating the peroxide-containing bleaching agent to generate a peracid. Preferably, the peroxide bleach activating agent is selected from an acetate generating compound such as, for example, an alkyl ester. Examples of suitable alkyl esters include, but are not limited to, glycerin triacetate, butanetriol triacetate, butylene glycol diacetate, ethylene glycol diacetate, propylene glycol diacetate, diethylene glycol diacetate, and combinations thereof.

In a preferred embodiment of the present invention, the peroxide bleach activating agent is present in amounts of from about 0.1 wt % to 90.0 wt % based on the total weight of the cleaning composition, preferably from about 25 wt % to 85 wt %, more preferably from about 30 wt % to 80 wt % and most preferably from about 50 wt % to 75 wt %.

The preferred amounts of the peroxide-containing bleaching agent component in the present cleaning composition are those amounts that would provide an amount of the peroxide-containing bleaching agent of up to 50 wt % based on the total weight of the cleaning composition, preferably from about 15 wt % to 35 wt %, and most preferably from about 19 wt % to 20 wt %. It is understood that the peroxide-containing bleaching agent component described above would be used at levels that could generate these amounts, so long as such amounts do not adversely affect the cleaning composition.

The cleaning composition may further include at least one surfactant in an amount sufficient to enable detersive action against soil deposited on substrates. The surfactants may be, for example, selected from suitable surface active compounds which are commercially available and described in the literature, e.g., in "Surface Active Agents and Detergents," Volumes 1 and 2 by Schwartz, Perry and Berch. The surfactant of the present invention may be selected from nonionic surfactants, anionic surfactants, cationic surfactants, amphoteric surfactants or combinations thereof. The surfactant may include mixtures of two or more types of surfactants formulated into the cleaning composition of the present invention.

In a preferred embodiment of the present invention, the surfactant may be present in an amount of at least 0.1 wt % based on the total weight of the cleaning composition, preferably from about 0.1 wt % to 60.0 wt %, more preferably from about 5 wt % to 40 wt %, and most preferably from about 10 wt % to 30 wt %.

Suitable anionic surfactants may be selected, for example, from alkyl ethoxy sulfates, alkyl sulfates, alkyl sulfonates, alkybenzyl sulfonates, branched alkyl sulfates, branched alkyl sulfonates, alkyl sulfosuccinates, diphenyloxide sulfonates, N-methyl taurates, alkyl isethionates, alkyl phosphate esters, and combinations thereof. Preferred anionic surfactants include alkyl sulfonates and alkylbenyl sulfonates and combinations thereof.

Suitable nonionic surfactants may be selected, for example, from ethoxylated fatty alcohols, propoxylated fatty alcohols, alkanol amides, ethoxylated alkanol amides, alkylphenol ethoxylates, and combinations thereof. Preferred ethoxylated fatty alcohols may be selected from C12-C15 ethoxylated fatty alcohols, and combinations thereof.

Suitable amphoteric surfactants may be selected, for example, from alkyl dimethyl amine oxides, alkyl betaines, alkyl amidopropyl betaines, alkyl ether hydroxypropyl sultaines, alkyl amidopropyl hydroxy sultaines, and combinations thereof. Preferred alkyl dimethyl amine oxides are selected from the group consisting of lauryl dimethyl amine oxide, decyl dimethyl amine oxide, and combinations thereof.

The cleaning composition of the present invention may further include one or more enzymes, which are capable of promoting enzymatic removal of soils from a substrate. Suitable enzymes include those selected from proteases, lipases, cutinases, amylases, pullulanases, xylanases, hemicellulases, cellulases, peroxidases, oxidases, mannanases, phospholipases, gluco-amylases, beta-glucanases, xyloglucanases, laccase, esterases, malanases, pectinases, lipoxygenases, reductases, ligninases, keratanases, tannases, transferase, pentosanases, arabinosidases, chondroitinases, dextranases, hyaluronidases, phenoloxidases, and combinations thereof. Preferred enzymes include those selected from proteases, lipases, cutinases, amylases, pullulanases, xylanases, hemicellulases, cellulases, peroxidases, oxidases, mannanases, and combinations thereof. Detergent compositions generally include a blend of conventional enzymes like protease, amylase, cellulase, lipase and the like.

In a preferred embodiment of the present invention, the enzyme may be present in an amount of at least 0.01 wt % based on the total weight of the cleaning composition, preferably from about 0.01 wt % to 20.00 wt %, more preferably from about 0.1 wt % to 10.0 wt %, and most preferably from about 0.5 wt % to 4.0 wt %.

Preferably, the cleaning compositions of the present invention are formulated to impart an in-wash pH of from 7.0 to 12.5, more preferably from 7.5 to 11.8, most preferably from 8.0 to 11.5. The cleaning compositions may further include a pH elevating agent. Suitable pH elevating agents include those selected from alkali metal salts of carbonate, hydrogen carbonate, phosphate, hydrogen phosphate, dihydrogen phosphate, polyphosphates, citrate, hydrogen citrate, dihydrogen citrate, diborate, triborate, tetraborate, octaborate, alkanol amines, and combinations thereof. In a preferred embodiment of the present invention, the pH elevating agents may be present in an amount of at least 0.1 wt % based on the total weight of the cleaning composition, preferably from about 0.1 wt % to 20.0 wt %, more preferably from about 1 wt % to 10 wt %.

The cleaning composition of the present invention may further include silica such as, for example, amorphous silica, colloidal silica, fumed silica, precipitated silica and combinations thereof. The silica is present in amounts sufficient to modify the rheology of the liquid to desired characteristics. Preferably, the silica is present in the cleaning composition in amounts of from about 0.1 wt % to 10.0 wt % based on the total weight of the cleaning composition, and more preferably from about 0.5 wt % to 5.0 wt %.

The composition of the present invention may further include one or more chelating agents in amounts sufficient to inhibit crystal growth or formation. Such chelating agents are capable of solublizing mineral deposits including sodium tripolyphosphate (STPP), for example. In particular, the chelating agents form bonds with metal ions to form soluble complex molecules, thus inactivating such ions and preventing them from reacting with other elements or ions to produce precipitates or scale. The complex molecules remain suspended and thus are easily rinsed away.

A suitable chelating agent is, for example, L-glutamic acid N,N-diacetic acid tetrasodium salt. It is understood that other known chelating agents such as, for example, those listed in the Kirk-Othmer Encyclopedia of Chemical Technology, Volume 5, 4th Ed. (1993), can also be used in the present invention. The chelating agents may be easily tested for suitability through routine methods by those skilled in the art in accordance with the present invention. The chelating agent may be present in specific amounts of up to 15 wt % based on the total weight of the cleaning composition, preferably up to 10 wt %, and more preferably from about 0.01 wt % to 8.00 wt %.

The cleaning compositions herein may contain other optional ingredients, including, but not limited to, perfumes, brighteners, buffers, fabric softeners, enzyme stabilizers, soil removing polymers, water softeners, dyes, rheology modifiers, foam control agents, surface modification agents, neutralizing agents and combinations thereof. These optional ingredients may be included at any functionally desirable level.

The unit dose cleaning product of the present invention further includes a pouch having a closed structure with an interior area (i.e., volume space) enclosing the cleaning composition. The pouch of the present invention may be of any form, shape and material suitable for retaining the cleaning composition without release of the cleaning composition from the pouch prior to contacting the pouch with an aqueous solution. The size of the pouch will depend on the amount of the cleaning composition, and the particular application. The present pouch is adapted to deliver the cleaning composition to form a solution in an aqueous environment. The cleaning composition can be formulated for any use including, but not limited to, fabric care, dishware washing, laundry cleaning, and other cleaning applications. Preferably, the present pouches may be constructed for use in an automatic dishwashing machine or laundry washing machine.

The pouch is made from a second at least partially water soluble material that is reactive to water to some degree. Preferably, the second at least partially water soluble material of the present invention is selected from any suitable film material that is stable and inert relative to the cleaning composition, and can range from partially soluble to fully soluble in aqueous solutions. Preferred second at least partially water soluble materials include, but are not limited to, polymeric materials, and preferably polymers capable of being formed into a film or sheet. More preferred second at least partially water soluble materials are selected from polyvinyl alcohol, polyvinyl pyrrolidone, cellulose ethers, carboxymethylcellulose, and the like. The most preferred second at least partially water soluble material is polyvinyl alcohol.

The second at least partially water soluble material of the present invention preferred for use herein possesses an average molecular weight of from about 1,000 to 300,000, preferably from about 2,000 to 150,000, more preferably from about 5,000 to 100,000, and most preferably from about 31,000 to 50,000.

Suitable commercially available film materials comprising a second at least partially water soluble material of the pouch are water soluble film products such as, for example, MONOSOL® M8630 film and M8310 film, sold by MonoSol, LLC of Merrillville, Ind., and those film materials described in U.S. Pat. No. 6,787,512, the content of which is incorporated herein by reference in its entirety.

In a preferred embodiment of the present invention, the second at least partially water soluble material of the pouch has a thickness of at least 10 μm, preferably at least 50 μm, and more preferably from about 50 μm to 300 μm.

In one embodiment of the present invention, the first at least partially water soluble material of the peroxide-containing bleaching agent component exhibits a substantially longer dissolution time than the second at least partially water soluble material of the pouch. The term "substantially longer dissolution time" means that the first at least partially water soluble material dissolves at a rate that enables the pouch of the present invention to react with water to release the cleaning composition before the encapsulated peroxide-containing bleaching agent component releases the peroxide-containing bleaching agent.

Furthermore, it is noted that having a pouch with a shorter dissolution time than the encapsulation or coating of the peroxide-containing bleaching agent component enables the active agents in the cleaning composition (e.g., surfactants and enzymes) to quickly disperse into the aqueous solution, while delaying release of the peroxide-containing bleaching agents so as not to interfere with the action of sensitive components such as enzymes. The delay in the release of the peroxide-containing bleaching agent allows the use of materials typically incompatible with the peroxide-containing bleaching agent such as, for example, surfactants and enzymes. In this way, the cleaning composition is allowed to act in solution before the peroxide-containing bleaching agent is released.

To enable the sequential release of the components of the unit dose cleaning product, the second at least partially water soluble material of the pouch may be formulated with greater water solubility than the first at least partially water soluble material of the peroxide-containing bleaching agent component. This can be readily achieved by selecting a different second at least partially water soluble material for the pouch from the first at least partially water soluble material for the coating or encapsulation of the peroxide-containing bleaching agent component. The pouch of the present invention is selected to release the present cleaning composition at a point in time earlier than the peroxide-containing bleaching agent component releases the peroxide-containing bleaching agent. In preferred embodiments of the invention, the peroxide-containing bleaching agent component releases the peroxide-containing bleaching agent at least 1 minute, preferably from about 2 minutes to 15 minutes, and more preferably from about 3 minutes to 6 minutes, after the release of the cleaning composition from the pouch.

In a preferred embodiment of the present invention, the pouch begins releasing the cleaning composition almost immediately upon contacting an aqueous solution, for example, in a laundry washing machine. Preferably, the pouch begins releasing the cleaning composition from about 1 second to about 120 seconds, and more preferably from about 1 second to about 20 seconds, after contacting the aqueous solution.

In one embodiment of the present invention, the second at least partially water soluble material is formed into a film or sheet. The pouch of the present invention is fabricated from the film material through any suitable methods known in the art including casting, extrusion, blow molding, blow extrusion, thermo-forming, vacuum-forming, and the like. The formed pouch is filled with the cleaning composition and sealed through suitable sealing techniques such as, for example, heat sealing, adhesives, compression or combinations thereof.

Preferably, in constructing unit dose cleaning products of the present invention, the present cleaning composition is first prepared with an organic solvent, preferably a non-aqueous liquid bleach activator, which is then added to a vessel and stirred with an overhead stirrer. The stirring rate is preferably sufficient to create a vortex about half-way down the total depth of the cleaning composition. A sufficient amount of fumed silica is then slowly added to the cleaning composition. The cleaning composition is mixed under stirring as described until the fumed silica is fully dispersed and no longer visible as individual particles. The stirring rate can then be slowed to create a smaller vortex, and a nonionic surfactant can be added at that time. Any additional ingredients, besides the peroxide-containing bleaching agent component, may be added thereafter. Finally, the peroxide-containing bleaching agent component is added. The system is stirred until the peroxide-containing bleaching agent component is fully dispersed to yield the final cleaning composition.

The film of the second at least partially water soluble material is then cut into suitably dimensioned pieces such as, for example, 3.5"×7". The piece is folded so as to make a 3.5" square, and the edges perpendicular to the fold are heat sealed with a FOODSAVER® model V2840 heat sealer product (marketed by Jarden Corporation of Rye, N.Y.) to form a pocket. About 20 g of the cleaning composition is added to the pocket made from the film, and the opening is then heat sealed to provide a completely sealed enclosure.

In another embodiment of the present invention, there is provided a method for cleaning soiled substrates by dissolving the unit dosing cleaning product in water to form a cleaning solution, and contacting the cleaning solution with the soiled substrates for a sufficient time to remove soils therefrom.

EXAMPLES

Example 1

Unit Dose Cleaning Product Compositions

A series of samples of a particulate peroxide-containing bleaching agent component was prepared comprising sodium percarbonate (PCS) (OXYPER® Grade FB400C obtained from Solvay North America, LLC of Houston, Tex.) encapsulated in a polyvinyl alcohol (PVOH) coating. Samples containing uncoated PCS were also prepared. The grades of the polyvinyl alcohol materials are listed below in Table 1.

TABLE 1

| Coating Material | % Degree of hydrolysis | Molecular Weight |
|---|---|---|
| 1) Polyvinyl alcohol partially hydrolyzed (PVOH PH) | 87-89 | 31,000-50,000 |
| 2) Polyvinyl alcohol fully hydrolyzed (PVOH FH) | 98-99 | 31,000-50,000 |

The coating materials listed in Table 1 were obtained from Sigma-Aldrich of St. Louis, Mo. under Catalog Nos. 363073 (PVOH PH product) and 363138 (PVOH FH product), respectively. Sodium percarbonate was loaded into a Glatt® GF3 fluidized bed coater, and spray coated with a corresponding 12-20% active PVOH solution to form encapsulated sodium percarbonate particles. The weight of the coating was 5% and 10% PVOH, respectively, based on the total weight of the coated particles.

Cleaning compositions were then prepared utilizing either encapsulated sodium percarbonate particles or uncoated PCS. The cleaning compositions included triacetin (a peroxide bleach activating agent), SURFONIC® L24-4 (a nonionic surfactant obtained from Huntsman International LLC of The Woodlands, Tex.), and AEROSIL® R80 (a hydrophobically-modified fumed silica obtained from Evonik Industries AG of Hanau, Germany). The samples prepared are listed below in Table 2. All values are given in weight %.

TABLE 2

| Cleaning Composition | Uncoated PCS | PCS (5% PVOH PH Coating) | PCS (10% PVOH PH Coating) | PCS (5% PVOH FH Coating) | PCS (10% PVOH FH Coating) | Nonionic Surfactant | Fumed Silica | Triacetin |
|---|---|---|---|---|---|---|---|---|
| 1 | 12.8 | — | — | — | — | 20.0 | 2.0 | 65.2 |
| 2 | — | 13.5 | — | — | — | 20.0 | 2.0 | 64.5 |
| 3 | — | — | 14.2 | — | — | 20.0 | 2.0 | 63.8 |
| 4 | — | — | — | 13.5 | — | 20.0 | 2.0 | 64.5 |
| 5 | — | — | — | — | 14.2 | 20.0 | 2.0 | 63.8 |

About 20 grams of each cleaning composition were placed into corresponding 3.5"×3.5" polyvinyl alcohol film pouches. The filled pouches were then sealed with a heat sealer. Four pouches were made for each cleaning composition and then placed in polystyrene jars. The jars were then placed in an oven heated to 50° C. The pouches were observed for a test period of up to 35 days at 50° C. There were no signs of bloating (evidence of peroxide degradation and subsequent oxygen gas generation) in any of the pouches during the test period.

Mass losses of the content of the pouches were estimated by weighing the initial mass of the pouch films and corresponding cleaning compositions, and then weighing the filled pouches after aging. In calculating the mass loss from the contents of the pouch, it was assumed that the film mass of the pouch remained constant. The average % mass loss values for each of the pouch samples are listed in Table 3 below.

TABLE 3

| Sample | Average % mass loss (14 days) | 14 day error | Average % mass loss (35 days) | 35 day error |
|---|---|---|---|---|
| 1 | 0.463 | 0.0120 | 0.617 | 0.0366 |
| 2 | 0.523 | 0.00656 | 0.575 | 0.00169 |
| 3 | 0.584 | 0.00872 | 0.730 | 0.0305 |
| 4 | 0.478 | 0.0157 | 0.571 | 0.0145 |
| 5 | 0.549 | 0.00262 | 0.688 | 0.0164 |

In all samples, mass losses were less than 1%, indicating very little solvent loss. Following 35 days, all samples were observed to be dry and non-sticky.

In order to assess active oxygen stability with regard to that generated from hydrogen peroxide and that generated from peracid, two types of titrations were performed. For each cleaning composition, the entire pouch sample was added to about 1600 mL of deionized water at 25° C. in a 2 L beaker. The resulting dilution was then stirred at about 200 rpm using a 3"×¾" magnetic stirrer. The pouch was closely observed for film dissolution, which typically occurred within one minute. Once the pouch was completely dissolved, a timer was initiated to measure the dissolution time of the PCS particles. The time observed for the coated and uncoated PCS particles to dissolve ranged from about 3 to 6 minutes, depending on the sample. The specific times are listed in Table 4 below.

TABLE 4

| Sample | Dissolution time of PCS particles (minutes) |
|---|---|
| 1 | 3 |
| 2 | 5 |

TABLE 4-continued

| Sample | Dissolution time of PCS particles (minutes) |
|---|---|
| 3 | 5 |
| 4 | 6 |
| 5 | 6 |

For each of the samples, about 10 mL of solution was extracted using a 10 mL syringe. The aliquot was then filtered through a 0.8 μm cellulose acetate filter into an Erlenmeyer flask. The mass of the aliquot was recorded, and the peroxide level in the aliquot was determined via titration with a 0.02 N $KMnO_4$ solution under acidic conditions. The oxidation of $H_2O_2$ by $MnO_4^-$ is expressed through the reaction:

$$5H_2O_2(aq)+6H^+(aq)+2MnO_4^- \rightarrow 5O_2+2Mn^{2+}(aq)+8H_2O$$

However, it is noted that the above reaction dictates that five equivalents are associated with each mole of $MnO_4^-$, and this consideration must be incorporated into the stoichiometry calculation. The permanganate titration is sensitive to only the level of peroxide present, and not the level of peracid. By measuring the level of $H_2O_2$ the same way at each interval, a gauge of peroxide stability can be established.

For analysis of peracid, a 5 mL aliquot of the test solution was removed after 10 minutes (following film dissolution) and filtered through a 0.8 μm cellulose acetate filter. The aliquot was then analyzed via an iodimetric titration over ice. The titration under acidic conditions is described through the following reaction:

$$RCOOOH+2I^-+2H^+ \rightarrow I_2+H_2O+RCOOH$$

In the procedure, 5.0 mL of 10% (w/w) KI (aq) was added to the aliquot on ice, followed by 5.0 mL of 10% (w/w) $H_2SO_4$ (aq). About 1 mL of a starch solution (Starch Indicator Solution Stabilized, Cat. No. SS408-1, available from Fisher Scientific of Fair Lawn, N.J.) was added in order to make $I_2$ more visually apparent. The sample was then titrated with 0.05 N $NaS_2O_3$ (aq) to a clear endpoint, indicating reduction of $I_2$:

$$2S_2O_3^{2-}+I_2 \rightarrow S_4O_6^{2-}+2I^-$$

The net equation, from which the stoichiometry was calculated, is:

$$RCOOOH+2S_2O_3^{2-}+2H+S_4O_6^{2-}+H_2O+RCOOH$$

Referring to FIG. 1, a graph is provided to show the levels of active oxygen (AO) due to peroxide and due to peracid at a time 0 (i.e., before aging). The values are shown as percentages of composition mass. As confirmed in the data, the levels of AO from peroxide were slightly different between samples, although the levels of peracid generated were similar.

Figure 2:
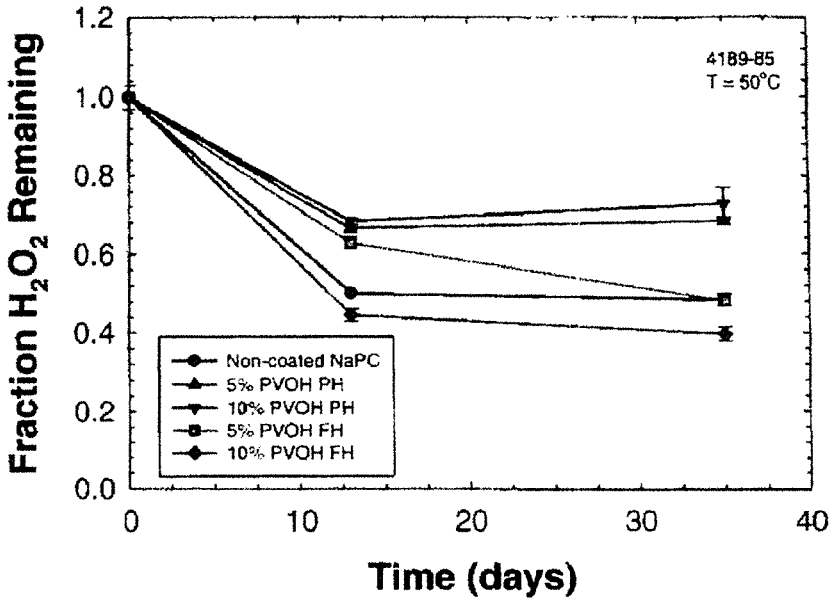
FIG. 2 is a graph plotting data corresponding to fractions of peroxide remaining for each of the samples as a function of time in accordance with the present invention.
Figure 3:
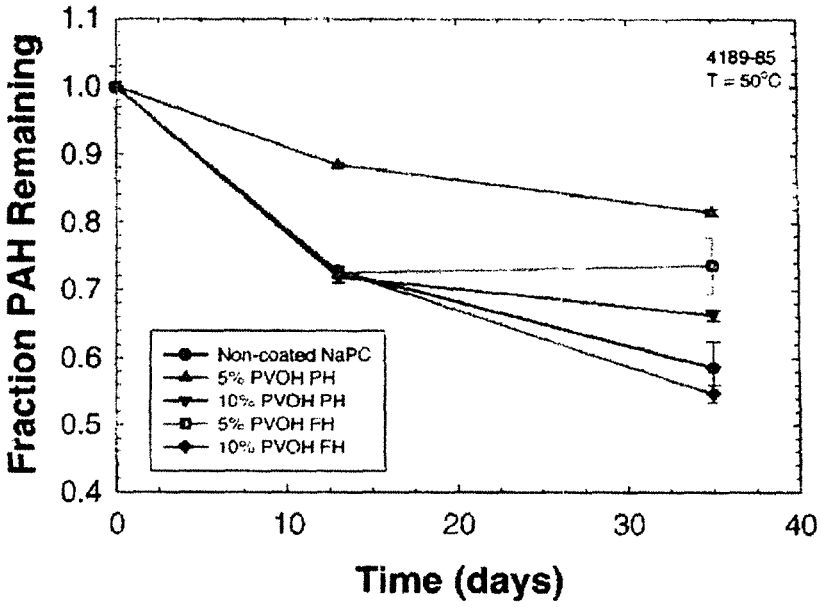
FIG. 3 is a graph plotting data corresponding to fractions of peracid generating capacity remaining for each of the samples as a function of time in accordance with the present invention.

Active oxygen stability, with regard to peroxide and peracid, were assessed using the procedure above, at aging intervals of 14 and 35 days (at 50° C. aging temperature). Plots of fractions of peroxide and peracid (or peracid generating capacity) for each of the samples as a function of time, are shown in FIGS. 2 and 3, respectively. The plots indicate that the PCS particles having a 5% PVOH PH coating maintained the highest stability with regards to both peroxide level and peracid generating ability. For example, after 35 days at 50° C., the 5% PVOH PH-coated PSC particles maintained 88% activity, while the non-coated system only exhibited 59% activity. The activity of the 10% PVOH PH-coated PSC particles, while slightly lower than the 5% PVOH PH-coated PSC particles, is still higher compared to the non-coated PSC particles.

Performance levels of the fully hydrolyzed (FH) coated PSC particles were consistently lower than those in the partially hydrolyzed coated PSC particles, therefore, encapsulation with partially hydrolyzed polyvinyl alcohol is preferred.

Example 2

Dissolution Testing of Pouch Film Materials

Three film materials were tested for use in producing unit dose pouches, each composed of polyvinyl alcohol and/or copolymers thereof. The film materials were evaluated for dissolution capacity. The films tested were M8630, M8310, and M8900, each commercially available from MonoSol LLC of Merrillville, Ind. The films had a nominal thickness of about 76 μm.

The films were cut into 10 mm×70 mm strips. A small paper binding clip was fastened to each end of the film strip. Each clip had a nominal mass of about 2.7 grams. Deionized water was then heated to a temperature of about 31° C. About 585 mL of the heated deionized water was added to a 500 mL glass graduate. A magnetic stirrer bar was then placed into the graduate and rotated at about 300 rpm. The stirring rate was sufficient to produce a slight vortex at the water surface. The film strip was then suspended from the top of the graduate and placed directly in the middle of the vortex. A timer was initiated, and the time required for film rupture and complete dissolution was then noted. Five replicates were performed for each film. Results of average dissolution times and errors with a 95% confidence interval are provided in Table 5 below.

TABLE 5

| Film | Dissolution Time (s) | ±(95% conf. int) |
|---|---|---|
| M8630 | 20.4 | 0.7 |
| M8310 | 25.6 | 2.1 |
| M8900 | 19.4 | 2.3 |

Film M8310 exhibited the longest dissolution time.

Example 3

Evaluating Coating or Film Forming PVOH Materials Based on Molecular Weight

Polyvinyl alcohol (PVOH) films were obtained to investigate the effects of coating thickness and molecular weight on dissolution time. The PVOH polymers listed in Table 6 below were studied.

TABLE 6

| MW | % Degree of hydrolysis | Supplier |
|---|---|---|
| 31K-50K | 87-89 | Sigma-Aldrich |
| 146K-186K | 87-89 | Sigma-Aldrich |

Coatings were produced by dissolving the 31K-50K PVOH polymer in water at a concentration of 20% (w/w) and the 146K-186K PVOH polymer at a concentration of 15.8% (w/w). Solutions were made by heating the water to about 80° C., and then adding the PVOH while stirring. Following full dissolution, the solutions were allowed to cool to room temperature. The solutions were then centrifuged at 4000 rpm for 15 minutes in order to remove air bubbles.

Coating layers having a nominal wet thickness of 25, 64, and 127 μm, respectively, were then drawn on release paper with a controlled thickness applicator. The coating layers were then placed in a 60° C. oven and allowed to dry for 2 hours.

The PVOH coating layers were cut into 10 mm×70 mm strips in the same manner as described in Example 2. Thicknesses at four different locations on each coating layer were then measured with a micrometer. The average of the 4 measurements was recorded as the strip thickness. The strips were then tested for dissolution times at 31° C. as noted in Example 2. Two to four coating layers from each nominal wet thickness film and MW were tested. All dissolution times were then plotted as a function of coating thickness. The experimental points were fitted to the following equation shown below:

$$T_D=cx_t^a$$

where $T_D$ is the dissolution time, $x_t$ is the coating thickness, and c and a are constants.

Figure 4:
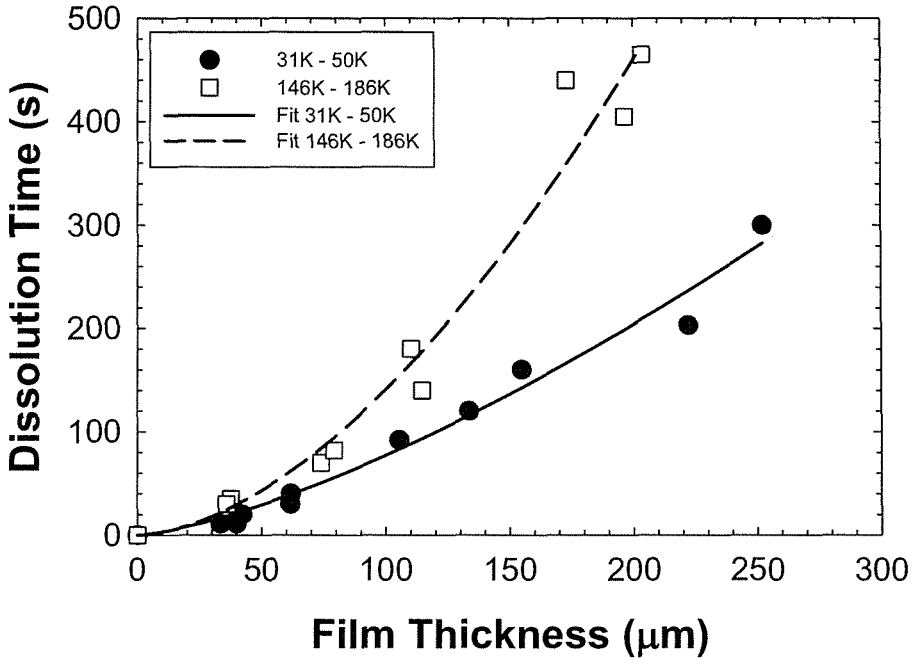
FIG. 4 is a graph plotting data corresponding to dissolution time of polyvinyl alcohol coating or film based on thickness and polymer weight, respectively, in accordance with the present invention.

The results of the test were plotted as shown in FIG. 4. The plot shows that dissolution time can be controlled by varying both coating thickness and polymer molecular weight. Therefore, by choosing appropriate values of each, dissolution time can be adjusted such that the relative dissolution time of the coating of the peroxide-containing bleaching agent is substantially longer than the dissolution time of the film pouch. It should be noted that the dissolution test presented here represents a relative measure of film dissolution, and that the actual release time of the encapsulated material may also depend on other factors such as particle size, shape, and the like. The present test is therefore meant to represent a starting point for selection of a coating material that exhibits a substantially longer dissolution time compared with the pouch film material. For example, the dissolution times of the PVOH coating films in the present example can be compared to those of the Monosol® pouch films of Example 2 at comparable thickness values as indicated in Table 7 below.

TABLE 7

| Film | Thickness (μm) | Dissolution Time (s) |
|---|---|---|
| Monosol ® M8630 | 76 | 20.4 |
| Monosol ® M8310 | 76 | 25.6 |
| Monosol ® M8900 | 76 | 19.4 |
| PVOH 31K-50K | 76 | 52.3 |
| PVOH 146K-186K | 76 | 87.9 |

The above data show that both grades of PVOH would be appropriate coating materials. If the thickness of the PVOH coating is varied, dissolution times can be shortened or lengthened as desired. The dissolution times based on film thickness and molecular weight are listed in Table 8 below.

TABLE 8

| Film | Thickness (μm) | Dissolution Time (s) |
|---|---|---|
| PVOH 31K-50K | 40 | 21.2 |
| PVOH 146K-186K | 40 | 29.3 |
| PVOH 31K-50K | 200 | 203.9 |
| PVOH 146K-186K | 200 | 460.1 |

Example 4

Evaluating Coating or Film Forming PVP Materials Based on Molecular Weight

A similar procedure to that in Example 3 was implemented to make coating layers composed of polyvinyl pyrrolidone (PVP), except that polymer solutions were formulated by using either a 38% (w/w) solution of a 55K MW PVP in ethanol or a 20% (w/w) solution of 1.3 million MW PVP in ethanol. The solutions were similarly drawn down on release paper using a controlled thickness applicator to produce coating layers. The coating layers were then allowed to dry overnight at room temperature. Dissolution times of the coating layers were evaluated and analyzed in terms of the same power-law expression used above.

Comparisons of the Monosol® film and PVP film dissolution times at the same thickness are provided in Table 9 below.

TABLE 9

| Film | Thickness (μm) | Dissolution Time (s) |
|---|---|---|
| Monosol ® M8630 | 76 | 20.4 |
| Monosol ® M8310 | 76 | 25.6 |
| Monosol ® M8900 | 76 | 19.4 |

TABLE 9-continued

| Film | Thickness (μm) | Dissolution Time (s) |
|---|---|---|
| PVP 55K | 76 | 9.8 |
| PVP 1.3 million | 76 | 15.6 |

In this case, PVP would not prove to be an adequate coating material, since its relative dissolution times are much shorter than those of the pouch films. Increasing PVP film thickness was determined to increase dissolution time of the coating layer as indicated in Table 10 below.

TABLE 10

| Film | Thickness (μm) | Dissolution Time (s) |
|---|---|---|
| PVP 55K | 200 | 28.6 |
| PVP 1.3 million | 200 | 64.4 |
| PVP 55K | 300 | 44.7 |
| PVP 1.3 million | 300 | 116.6 |

It is understood that the dissolution test as described above provides a method of comparing the relative dissolution characteristics of coating and pouch materials. The film thicknesses and corresponding times noted in these tests may not directly translate to dissolution times associated with coatings applied to encapsulated particles, as such dissolution times may also depend on total particle surface area relative to volume, particle shape, and the like. However, the test does allow the coating materials to be ranked as to whether such coating materials can dissolve faster or slower than the pouch film materials, and thus provides a starting point for appropriate selection of suitable first and second at least partially water soluble materials for use in making coatings and pouches.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A unit dose cleaning product for delivering a peroxide-containing bleaching agent, comprising:

a) a peroxide-containing bleaching agent component comprising a peroxide-containing bleaching agent, wherein said peroxide-containing bleaching agent is encapsulated in a first at least partially water soluble material, and said first at least partially water soluble material is selected from the group consisting of polyvinyl alcohol, polyvinyl pyrrolidone, and combinations thereof;

b) a peroxide bleach activating agent component comprising a peroxide bleach activating agent and having said peroxide-containing bleaching agent component dispersed therein forming a cleaning composition, wherein said peroxide bleach activating agent is in the form of a non-aqueous liquid and said activating agent component is present in an amount of 25-85 wt % of said cleaning composition; and c) a pouch comprising a second at least partially water soluble material fully enclosing said cleaning composition, wherein said second at least partially water soluble material is selected from the group consisting of polyvinyl alcohol polyvinyl pyrrolidone, and combinations thereof, and said first at least partially water soluble material of the peroxide-containing bleaching agent component exhibits a substantially longer dissolution time than said second at least partially water soluble material of said pouch.

2. The cleaning product of claim 1 wherein the peroxide bleaching activating agent activates the peroxide-containing bleaching agent to generate a peracid.

3. The cleaning product of claim 1 wherein the peroxide bleach activating agent is an acetate generating compound.

4. The cleaning product of claim 1 wherein the peroxide bleach activating agent is present in amounts of from about 50 wt % to 75 wt % based on the total weight of the cleaning composition.

5. The cleaning product of claim 1 wherein the peroxide-containing bleaching agent is selected from the group consisting of sodium perborate, sodium percarbonate, sodium perphosphate, sodium persulfate, urea peroxide, polyvinylpyrrolidone peroxide and combinations thereof.

6. The cleaning product of claim 1 wherein the peroxide-containing bleaching agent is present in amounts of up to 50 wt % based on the total weight of the cleaning composition.

7. The cleaning product of claim 6 wherein the peroxide-containing bleaching agent is present in amounts of from about 15 wt % to 35 wt % based on the total weight of the cleaning composition.

8. The cleaning product of claim 1 wherein the cleaning composition further comprises a surfactant.

9. The cleaning product of claim 8 wherein the surfactant is selected from the group consisting of nonionic surfactants, anionic surfactants, cationic surfactants, amphoteric surfactants, and combinations thereof.

10. The cleaning product of claim 8 wherein the surfactant is present in amounts of from about 0.1 wt % to 60 wt % based on the total weight of the cleaning composition.

11. The cleaning product of claim 10 wherein the surfactant is present in amounts of from about 5 wt % to 40 wt % based on the total weight of the cleaning composition.

12. The cleaning product of claim 1 wherein the cleaning composition further comprises an enzyme.

13. The cleaning product of claim 12 wherein the enzyme is selected form the group consisting of proteases, lipases, cutinases, amylases, pullulanases, xylanases, hemicellulases, cellulases, peroxidases, oxidases, mannanases, and combinations thereof.

14. The cleaning product of claim 12 wherein the enzyme is present in amounts of from about 0.01 wt % to 20.00 wt % based on the total weight of the cleaning composition.

15. the cleaning product of claim 1 wherein the cleaning composition further comprises a pH elevating agent.

16. The cleaning product of claim 15 wherein the pH elevating agent is selected from the group consisting of alkali metal salts of carbonate, hydrogen carbonate, phosphate, hydrogen citrate, dihydrogen citrate, diborate, triborate, tetraborate, octaborate, alkanol amines, and combinations thereof.

17. The cleaning product of claim 15 wherein the pH elevating agent is present in amounts of from about 1 wt % to 10 wt % based on the total weight of the cleaning composition.

18. The cleaning product of claim 1 wherein the cleaning composition further comprises silica.

19. The cleaning product of claim 18 wherein the silica is fumed silica.

20. The cleaning product of claim 18 wherein the silica is present in amounts of from about 0.5 wt % to 5.0 wt % based on the total weight of the cleaning composition.

21. The cleaning product of claim 1 wherein said first at least partially water soluble material is a polyvinyl alcohol comprises a molecular weight of from about 31,000 to 50,000.

22. The cleaning product of claim 1 wherein the first at least partially water soluble material is present in an amount of from about 5 wt % to 15 wt % based on the total weight of the peroxide-containing bleaching agent component.

23. The cleaning product of claim 1 wherein the dissolution time of the first at least partially water soluble material is from about 3 minutes to 6 minutes.

24. The cleaning product of claim 1 wherein the peroxide-containing bleaching agent is present in amounts of from about 85 wt % to 95 wt % based on the total weight of the peroxide-containing bleaching agent component.

25. The cleaning product of claim 1 wherein the peroxide-containing bleaching agent component has a mean particle diameter of from about 100 μm to 2000 μm.

26. The cleaning product of claim 1 wherein said second at least partially water soluble material is a polyvinyl alcohol comprises a molecular weight of from about 31,000 to 50,000.

27. The cleaning product of claim 1 wherein the second at least partially water soluble material has a thickness of at least 10 μm.

28. The cleaning product of claim 27 wherein the thickness of the second at least partially water soluble material is in the range of from about 50 μm to 300 μm.

29. The cleaning product of claim 1 wherein the dissolution time of the second at least partially water soluble material is from about 1 second to 20 seconds.

30. The cleaning product of claim 1 wherein the peroxide-containing bleaching agent is released at least one minute after release of the cleaning composition from the pouch.

31. The cleaning product of claim 30 wherein the peroxide-containing bleaching agent is released from about 2 to 15 minutes after release of the cleaning composition from the pouch.

32. A method of cleaning soiled substrates, comprising:

dissolving the unit dose cleaning product of claim 1 in water to form a cleaning solution; and contacting the cleaning solution with the soiled substrates to remove soils therefrom.

* * * * *